United States Patent [19]

Kozacka et al.

[11] 4,179,677

[45] Dec. 18, 1979

[54] COMBINATION OF FUSIBLE ELEMENTS FOR ELECTRIC FUSES

[75] Inventors: Frederick J. Kozacka, South Hampton, N.H.; Richard J. Perreault, Amesbury, Mass.

[73] Assignee: Gould Inc., Rolling Meadows, Ill.

[21] Appl. No.: 905,960

[22] Filed: May 15, 1978

[51] Int. Cl.[2] ..... H01H 85/12

[52] U.S. Cl. ..... 337/161; 337/293

[58] Field of Search ..... 337/161, 158, 159, 162, 337/163, 164, 166, 279, 292, 293, 229

[56] References Cited

U.S. PATENT DOCUMENTS

| | | | |
|---|---|---|---|
| 2,988,620 | 6/1961 | Kozacka | 337/161 |
| 3,020,372 | 2/1962 | Kozacka | 337/293 |
| 3,238,333 | 3/1966 | Kozacka | 337/166 |
| 3,394,333 | 7/1968 | Jacobs, Jr. | 337/229 |
| 4,048,609 | 9/1977 | Knapp, Jr. | 337/159 |

*Primary Examiner*—Harold Broome
*Attorney, Agent, or Firm*—Erwin Salzer

[57] ABSTRACT

A plurality of ribbon-type fusible elements is arranged in parallel. Each of them includes a plurality of serially arranged points of reduced cross-sectional area. Each of these points is formed by a perforation and two current paths, each to opposite sides of the perforation. Along the plurality of fusible elements, like rungs of a ladder, is arranged a plurality of separate pairs of members of electric insulating material, each covering at least two points of the plurality of points of reduced cross-section. Fastener means project through each of the pairs of insulating members to firmly position the same in relation to the plurality of fusible elements.

4 Claims, 6 Drawing Figures

COMBINATION OF FUSIBLE ELEMENTS FOR ELECTRIC FUSES

BACKGROUND OF THE INVENTION

A plurality of fusible elements that are connected in parallel into an electric circuit is a much more effective arc extinguisher than a single fusible element having the same current-carrying capacity. This is particularly true where the currents under interruption are of a relatively small magnitude, or of medium magnitude, say in the order of ten times the rated current of the fuse.

A plurality of separate fusible elements is likely to form an initial clean break at least at one, or at several different points of the fusible elements. Assuming that but one break has initially formed in a plurality of fusible elements connected in parallel into an electric circuit, the remaining fusible elements, i.e. those in which no break has been formed as yet, must carry the entire fault current. This, in turn, greatly accelerates the formation of breaks and the velocity of burnback in the fusible elements which initially remained intact.

It is one object of the invention to provide a fusible element structure for electric fuses which utilises the above phenomenon and which greatly increase the probability of formation of breaks. Other objects of the invention will become more apparent as this specification proceeds.

The closest prior art known to me is U.S. Pat. No. 4,048,609; Sept. 13, 1977 to E. J. Knapp, Jr. for LATTICE STRUCTURE FOR ELECTRIC FUSES COMPRISING FUSIBLE ELEMENTS AND INSULATING SUPPORTS THEREFOR and Patent Application Ser. No. 849,171; Nov. 7, 1977 of Frederick J. Kozacka for COMBINATION OF FUSIBLE ELEMENTS FOR ELECTRIC FUSES.

SUMMARY OF THE INVENTION

Structures according to this invention include a plurality of parallel ribbon-type fusible elements. The preponderant portion of the length of said plurality of fusible elements is arranged in a common plane. Each of said plurality of fusible elements has a plurality of serially arranged points of reduced cross-sectional area. Each of said plurality of points of reduced cross-sectional area consists of a perforation and a pair of current paths each to opposite sides of said perforation. A plurality of separate pairs of electric insulating members is arranged transversely to said plurality of fusible elements and extends across said plurality of fusible elements. The term separate means in this context that said plurality of pairs of electric insulating members are not interconnected by any insulating structure. Each of said pairs of electric insulating members sandwiches said plurality of fusible elements at at least two points of said plurality of points of reduced cross-section. Said plurality of pairs of electric insulating members consist of a laminate of glass-cloth and a synthetic resin. Fastener means project through each of said plurality of pairs of electric insulating members to firmly position the same relative to said plurality of fusible elements.

DESCRIPTION OF PREFERRED EMBODIMENTS

Figure 1:
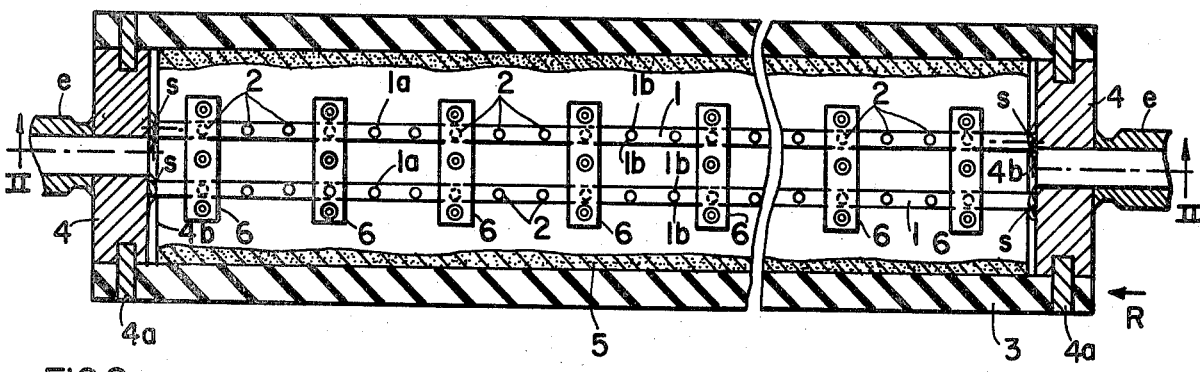
FIG. 1 is in part a front elevation and in part a longitudinal section of a fuse provided with fusible elements according to the present invention.
Figure 2:
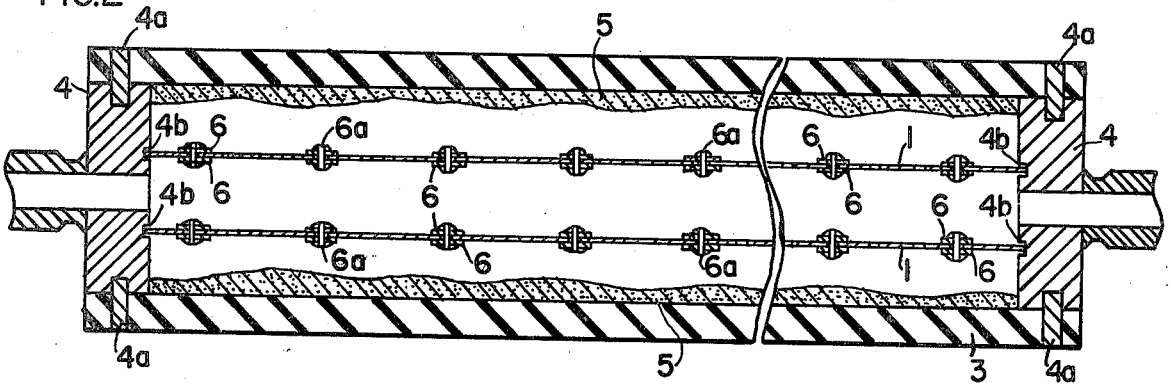
FIG. 2 is in part a front elevation and in part a longitudinal section along II—II of FIG. 1.
Figure 3:
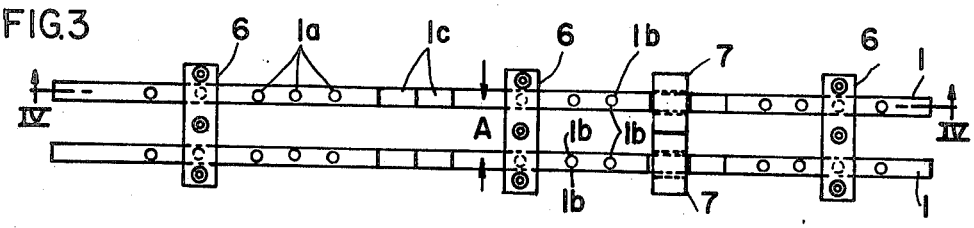
FIG. 3 is a top-plan view of a modification of the structure of FIG. 1, omitting the casing, its terminal elements and the pulverulent arc-quenching filler.
Figure 4:
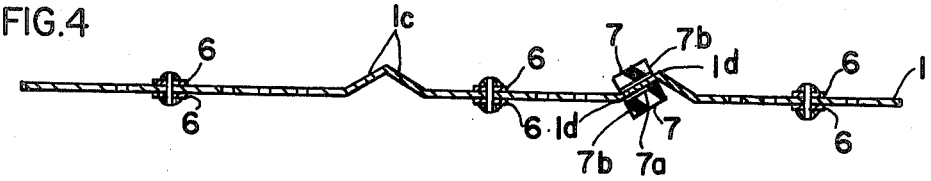
FIG. 4 is substantially a side elevtion of the structure of FIG. 3.
Figure 5:
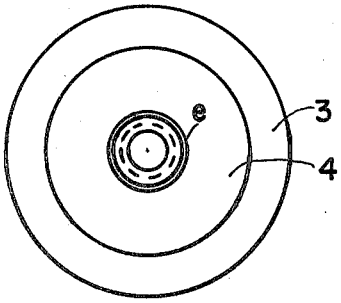
FIG. 5 is an end view of the structure of FIG. 1 seen in the direction of the arrow R thereof.
Figure 6:
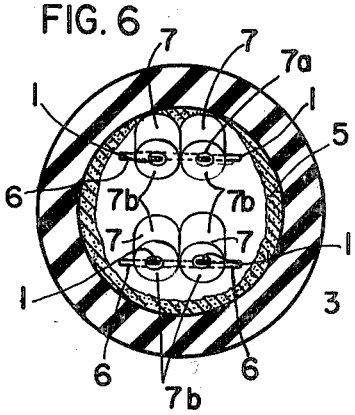
FIG. 6 is a transverse section across a fuse including fusible elements as shown in FIGS. 3 and 4.

In the drawing, and more particularly in FIGS. 1 and 2 thereof, reference numeral 1 has been applied to designate a plurality of ribbon-type fusible elements, preferably of sheet silver. In FIGS. 1 and 2 all of the fusible elements 1 are arranged in a common plane, while FIGS. 3 and 4 show an embodiment of the invention wherein only the preponderant portion of the length of the fusible elements are arranged in a common plane. FIGS. 1 to 4, inclusive, show but two fusible elements 1 which are connected in parallel in an electric circuit, but the larger the number of fusible elements which are connected in parallel in an electric circuit, the more effective the combination of fusible elements according to the present invention works. Each of the plurality of fusible elements 1 has a plurality of serially arranged points 2 of reduced cross-sectional area. Each of this plurality of points of reduced cross-sectional area consists of a perforation 1*a* in fusible elements 1 and two current paths 1*b* one to each side of perforation 1*a*. Fusible elements 1 are housed in a tubular casing 3 of electric insulating material closed on both ends thereof by terminal elements 4 in the form of plugs. Pins 4*a* join casing 3 and terminal elements 4. Terminal elements or plugs 4 are provided on the axially inner end surfaces thereof with grooves 4*b* which are engaged by the ends of fusible elements 1. Solder joints s inside of grooves 4*b* conductively connect plugs 4 and the ends of fusible elements 1. Fusible elements 1 are embedded in a granular arc-quenching filler 5. Filler 5 has been shown only at the interface with casing 1, but actually fills the entire space of casing 1 not occupied by other parts. A plurality of separate pairs of electric insulating members 6 is arranged transversely to said plurality of fusible elements 1, and extends across said plurality of fusible elements. Each of said parts of electric insulating members sandwiches said plurality of fusible elements at least at two points of reduced cross-section of said plurality of points of reduced cross-section. Members 6 are made of a laminate of glass-cloth and a synthetic resin, preferably a melamine resin. Members 6 are not interconnected by any insulating or any conductive structure, such as a bar of insulating material extending in a direction parallel to fusible elements 1. Provision of such a bar of electric insulating material is unnecessary in the instant case since fusible elements 1 have sufficient stability to be self-supporting. In such circumstances any interconnections of insulating members 6 would be damaging since they are made of a laminate of glass-cloth and a synthetic resin and thus subject to tracking, though only to a relatively small extent. Fastener means 6*a*, such as rivets or eyelets, project through each of said plurality of pairs of electric insulating members 6 to firmly position the same relative to said plurality of fusible elements.

Fusible elements 1 may be provided with any suitable extensions for connecting the fuse into an electric circuit such as, e.g. tubular cable connectors e.

Referring now to FIGS. 3 and 4, numeral 1 has been applied to indicate a pair of fusible elements to be mounted in an electric fuse in the fashion shown in FIGS. 1 and 2. Fusible elements 1 include a plurality of perforations 1*a*, reducing the cross-sectional area thereof. Conductive current paths 1*b* are left to both sides of perforations 1*a*. The members 6 of a glass-cloth laminate extend transversely across fusible elements 1, sandwiching fusible elements 1 therebetween. Each member 6 is coextensive with at least one pair of perforations 1*a*, i.e. each member covers as many perforations 1*a* as the number of fusible elements that are tied together by one of insulating bridges 6.

Reference character A has been applied in FIG. 3 to indicate the spacing between contiguous fusible elements 1 and reference numeral 7 has been applied to indicate a pair of beads of material that evolves a gas under the heat of electric arcs, as described mor in detail in U.S. Pat. No. 3,810,062; May 7, 1974 to Frederick J. Kozacka for HIGH-VOLTAGE FUSE HAVING FULL RANGE CLEARING ABILITY. Beads 7 are cylindrical and are mounted with a center perforation 7*a* thereof on fusible elements 1. Their radii are substantially equal to one half of distance A so that said beads 7 perform the dual function of producing an arc-extinguishing blast action and of maintaining the spacing A between fusible elements 1. The preponderant portion of the length of fusible elements 1 is planar, except at 1*c* and 1*d*. The fusible elements 1 have bends at 1*d* which are coextensive with the end surfaces 7*b* of beads 7. Consequently beads 7 operate as spacers between fusible elements 1 without the need of fasteners for attaching the former to the latter.

In operation each of insulating bridges 6 produces a hot point that is a potential break. Where one of fusible elements 1 melts, the other fusible element is compelled to carry the entire current and melts after a predetermined delay time. This delay time is significantly shortened by the formation of a plurality of potential points of break on the second element to melt last. The shortening of the delay time is due to the presence of preheated points 2 of reduced cross-sectional area at elevated temperatures.

The effectiveness of a fuse structure according to this invention depends largely upon the circuit voltage. The higher the circuit voltage, the longer the fusible element, the flatter the temperature distribution curve along the fuse, and the larger the probability that a break will form in a second fusible element shortly after a break has been formed in a first fusible element.

We claim as our invention:

1. A combination of fusible elements for electric fuses comprising (a) a plurality of parallel ribbon-type fusible elements, the preponderant portion of the length of said plurality of fusible elements being arranged in a common plane;

(b) each of said plurality of fusible elements having a plurality of serially arranged points of reduced cross-sectional area;

(c) said plurality of points of reduced cross-sectional area each consisting of a perforation and a pair of current paths each to opposite sides of said perforation;

(d) a plurality of separate pairs of electric insulating members arranged transversely to said plurality of fusible elements and extending across said plurality of fusible elements, each of said pairs of electric insulating members sandwiching said plurality of fusible elements at at least two points of reduced cross-sectional area of said plurality of points of reduced cross-sectional area;

(e) said plurality of pairs of electric insulating members consisting of a laminate of glass-cloth and synthetic resin;

(f) said plurality of pairs of electric insulating members being non-interconnected by any insulating or conductive structure; and (g) fastener means projecting through each of said plurality of pairs of electric insulating members to firmly position the same relative to said plurality of fusible elements.

2. A combination of fusible elements for electric fuses as specified in claim 1 wherein said plurality of pairs of electric insulating members comprise a laminate of glass-cloth and a melamine resin.

3. A combination of fusible elements for electric fuses as specified in claim 1 wherein the spacing between the centers of said plurality of fusible elements is a predetermined distance, and wherein beads of a gas-evolving material are mounted on said plurality of fusible elements whose radii are substantially equal to one half of said predetermined distance so that said beads perform the dual function of arc-extinguishers by blast action and of maintaining the spacing between said plurality of fusible elements.

4. A combination of fusible elements for electric fuses as specified in claim 3 wherein the portion of said plurality of fusible elements on which said gas-evolving beads are mounted project out of their common plane and form bends substantially coextensive with the end surfaces of said beads.

* * * * *